US006045282A

United States Patent [19]

Begin

[11] Patent Number: 6,045,282

[45] Date of Patent: Apr. 4, 2000

[54] MULTI-ROLLER PAINT APPLICATOR SYSTEM

[76] Inventor: Paul Begin, 145 Whipple Rd., Pascoag, R.I. 02856

[21] Appl. No.: 08/978,708

[22] Filed: Nov. 26, 1997

[51] Int. Cl.[7] ..... B05C 1/00

[52] U.S. Cl. ..... 401/197; 401/9

[58] Field of Search ..... 401/197, 9, 10, 401/193, 208, 220; 15/230.11

[56] References Cited

U.S. PATENT DOCUMENTS

| | | | |
|---|---|---|---|
| 2,813,292 | 11/1957 | McLendon | 15/230 |
| 3,776,645 | 12/1973 | Walker | 401/197 X |
| 4,222,678 | 9/1980 | Miller | 401/218 |
| 4,335,484 | 6/1982 | Ridge et al. | 15/230.11 |
| 4,639,156 | 1/1987 | Stern et al. | 401/146 |
| 4,644,604 | 2/1987 | Kierce | 15/244 A |
| 4,728,213 | 3/1988 | Geberth, Jr. | 401/197 |
| 4,822,194 | 4/1989 | Simonette | 401/207 |
| 5,035,022 | 7/1991 | Iuliano et al. | 15/118 |

FOREIGN PATENT DOCUMENTS

| | | | |
|---|---|---|---|
| 375579 | 6/1990 | European Pat. Off. | 401/197 |
| 25024 | 4/1963 | German Dem. Rep. | 15/230.11 |
| 45528 | 11/1966 | German Dem. Rep. | 15/230.11 |
| 1558712 | 4/1990 | Russian Federation | 15/230.11 |

*Primary Examiner*—David J. Walczak
*Attorney, Agent, or Firm*—Gravey, Smith, Nehrbass & Doody, LLC

[57] ABSTRACT

A tri-roller painting assembly having a main body portion, including a lower handle portion and an upper roller support portion. The upper roller support portion supports a first roller rotationally mounted along the face of the upper support surface, which rotates but is stationary along its rotational axis. There is further provided a pair of movable arms mounted to the upper face portion of the system, with each of the arms movable between a first closed position and a second open position. Each of the arms further includes a roller extending perpendicular therefrom, with the rollers extending therefrom positioned in parallel relation and perpendicular to the first roller. There is further provided a trigger member on the handle so that when the trigger member is squeezed by the user of the apparatus, the movable arms are moved from the first end position to the second out position so that the pair of rollers may accommodate various widths of boards or the like. There is further provided a spring or expandable member, interconnecting the two arms so that when the trigger member is released, the two arms are pulled toward the closed position by the spring member for being held firmly against the sides of the surface to be painted. Further, there is provided a paint delivery system which includes a single paint feed line extending through the handle member and diverging into three separate lines with a first line feeding paint to the core of the first stationary roller member, and the second and third lines feeding paint into the core of each of the parallel roller members, thus enabling the user of the apparatus to paint varying widths of boards or type surfaces, which can adjust automatically to the different widths of the surfaces and can have a continuous paint feed into the system so that painting can continue without having to be interrupted during the painting process.

15 Claims, 4 Drawing Sheets

MULTI-ROLLER PAINT APPLICATOR SYSTEM

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

1. Field of the Invention

The apparatus and system of the present invention relates to application of paint on a surface. More particularly, the present invention relates to a system having a plurality of rollers configured as to paint simultaneously three surfaces of an object, such as a post, with a continuous supply of paint into the rollers during the painting process.

2. General Background of the Invention

In the art of painting, it is quite common that painters utilize a roller applicator, rather than a brush so as to be more efficient in the application of paint, and to apply paint evenly over the surface to be painted. As part of such a system in the development of the art, there has been provided a system for feeding a continuous supply of paint into the roller, through a pump means or the like, so that as the roller is rolled across the surface, the paint is supplied to the roller, so that one does not have to interrupt the painting process by having to obtain additional paint onto the roller surface.

There were several patents found in a patentability search of the art, which included for example, U.S. Pat. No. 2,813,292, entitled "Paint Applicators of the Manually Operated Roller Type" that could be used on objects with a circular cross-section (such as a pipe), but does not automatically self-adjust to the varying widths of the surface to be painted while operating.

Further, U.S. Pat. No. 5,035,022 entitled "Device for Applying Coatings to Objects Having Irregular Shapes and/or Diverse Surfaces" teaches an applicator that can be used on objects of varied but fixed cross-sections, similar to the '292 patent, having no width adjustment while in use, therefore making the applicator very difficult to utilize on varying width objects.

U.S. Pat. No. 4,335,484 entitled "Fence Picket Roller Painter" can be used on an object of a fixed width such as a fence picket. No adjustments can be made for either initial cross section or varying width while in use.

Further, U.S. Pat. No. 4,728,213 entitled "Power Roller Assembly" teaches a paint roller assembly that uses a pressurized paint supply to feed the perforated roller from the interior surface.

U.S. Pat. No. 4,822,192 teaches a paint delivery system terminating with a flat pad assembly, as opposed to rollers.

U.S. Pat. No. 4,222,678 entitled "Pressure Fed Roller Type Fluid Applicator" teaches a paint roller assembly which delivers pressurized paint to the exterior surface of a single roller and not multiple rollers.

U.S. Pat. No. 4,639,156 entitled "Painting Apparatus and Method" describes a complete pressurized painting system that delivers pressurized paint to the interior of a paint roller assembly or flat pad.

U.S. Pat. No. 4,644,604 entitled "Roller Paint Applicator for Wrought Iron Railing" teaches a dual roller paint applicator which can be used to paint two sides of an object of a varying width, specifically designed to apply paint to a wrought iron railing. A varying width object is accommodated by having the operator apply pressure to the spring handle of the applicator to keep the rollers in contact with the object surface.

These patents are included in a prior art statement submitted with the application being submitted herewith.

BRIEF SUMMARY OF THE INVENTION

The apparatus and system of the present invention solves the problems in the art in a simple and straightforward manner. What is provided is a tri-roller paint system which comprises, in effect, three distinct subsystems, i.e. the roller assembly which includes a plurality or three rollers, the handle, support structures and associated parts; a paint delivery system which comprises associated tubing and fittings for delivering paint through the three rollers; and the roller separation system that includes the trigger and a monofilament line and support parts.

What is provided is a roller assembly having a main body portion, including a lower handle portion and an upper roller support portion. The upper roller support portion supports a first roller rotationally mounted along the face of the upper support surface, which rotates, but is stationary along its rotational axis. There is further provided a pair of movable arms mounted to the upper face portion of the system, with each of the arms movable between a first closed position and a second open position. Each of the arms further includes a roller extending perpendicular therefrom, with the rollers extending therefrom positioned in parallel relation and perpendicular to the first roller. There is further provided a trigger member on the handle so that when the trigger member is squeezed by the user of the apparatus, the movable arms are moved from the first closed position to a second open position so that the pair of rollers may accommodate various widths of boards or the like. There is further provided a spring or expandable member, interconnecting the two arms so that when the trigger member is released, the two arms are pulled toward the closed position by the spring member for being held firmly against the sides of the surface to be painted. Further, there is provided a paint delivery system which includes a single paint feed line extending through the handle member and diverging into three separate lines with a first line feeding paint to the core of the first stationary roller member, and the second and third lines feeding paint into the core of each of the parallel moveable roller members, thus enabling the user of the apparatus to paint varying widths of boards or type surfaces, which can adjust automatically to the different widths of the surfaces and can have a continuous paint feed into the system so that painting can continue without having to be interrupted during the painting process. It should be noted that the multi-roller system may be used as a manual system, with the rollers being placed within conventional paint trays for receiving paint rather than the paint being fed into the rollers automatically.

Therefore, it is the principal object of the present invention to provide a multi-roller assembly which enables the applicator to paint three separate surfaces of an item such as a fence picket simultaneously and to accommodate varying widths of the surface during the painting process;

It is the further object of the present invention to provide a paint applicator assembly, which may include an automatic paint delivery system to three separate, distinct rollers so as to allow continuous painting with the applicator, or a manual system where paint can be placed onto the rollers via paint pans;

It is the further object of the present invention to provide a paint roller assembly having multiple rollers in perpendicular relationship, with at least a pair of the rollers having the ability to be able to move inward and outward in relation to one another, so as to accommodate varying widths of a surface to be painted.

It is a further object of the present invention to provide a tri-roller paint delivery system which is composed of three separate distinct sub systems, i.e. the roller assembly; the paint delivery system; and the roller separation system for comprising the entire assembly which enables painting to be done uninterrupted and on various width surfaces during the painting process.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
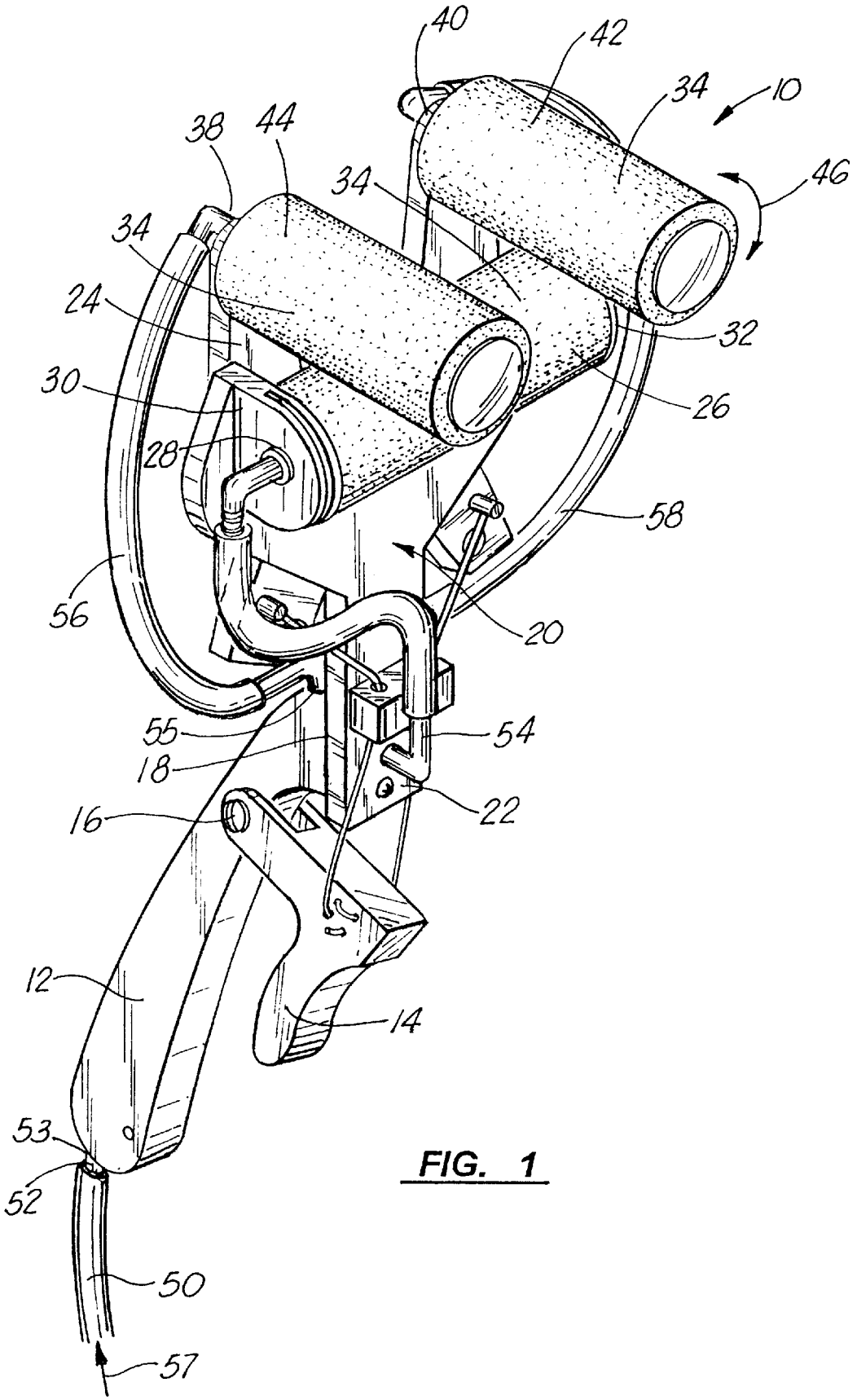
FIG. 1 illustrates an overall perspective view of the preferred embodiment of the apparatus of the present invention.

FIGS. 1–4 illustrate the preferred embodiment of the apparatus of the present invention by the numeral 10. As illustrated in overall view in FIG. 1, apparatus 10 defines a tri-roller paint assembly which comprises a first handle portion 12 on which a person would grab the apparatus, with a movable trigger 14 mounted via a single axial screw 16, as will be described further. At the top portion 18 of handle member 12, there is mounted an upper support base 20 which includes a lower mounting portion 22 and an upper paint roller support portion 24. As is illustrated in the figures, upper support portion 24, there is first mounted a lower paint roller 26 mounted along a single axis 28 on mounting brackets 30, 32, so that roller 26 is able to rotate freely along the axis. Roller 26 would be of the typical type roller having an inner core portion (which is not shown in the drawings), and an outer sponge-like paint delivery surface 34 of the type that is known in the art. As seen further, the upper support base 20 includes a pair of upper mounting arms 38, 40, which likewise mount a pair of second and third rollers 42, 44 with rollers 42 and 44 mounted along a single axis extending perpendicular to the alignment of lower roller 26. Again, rollers 42, 44 would rotate freely in the direction of arrow 46 and as with roller 26, would likewise have an inner core member and an outer sponge-like paint delivery surface 34, again, that is commonly known in the art.

Figure 2:
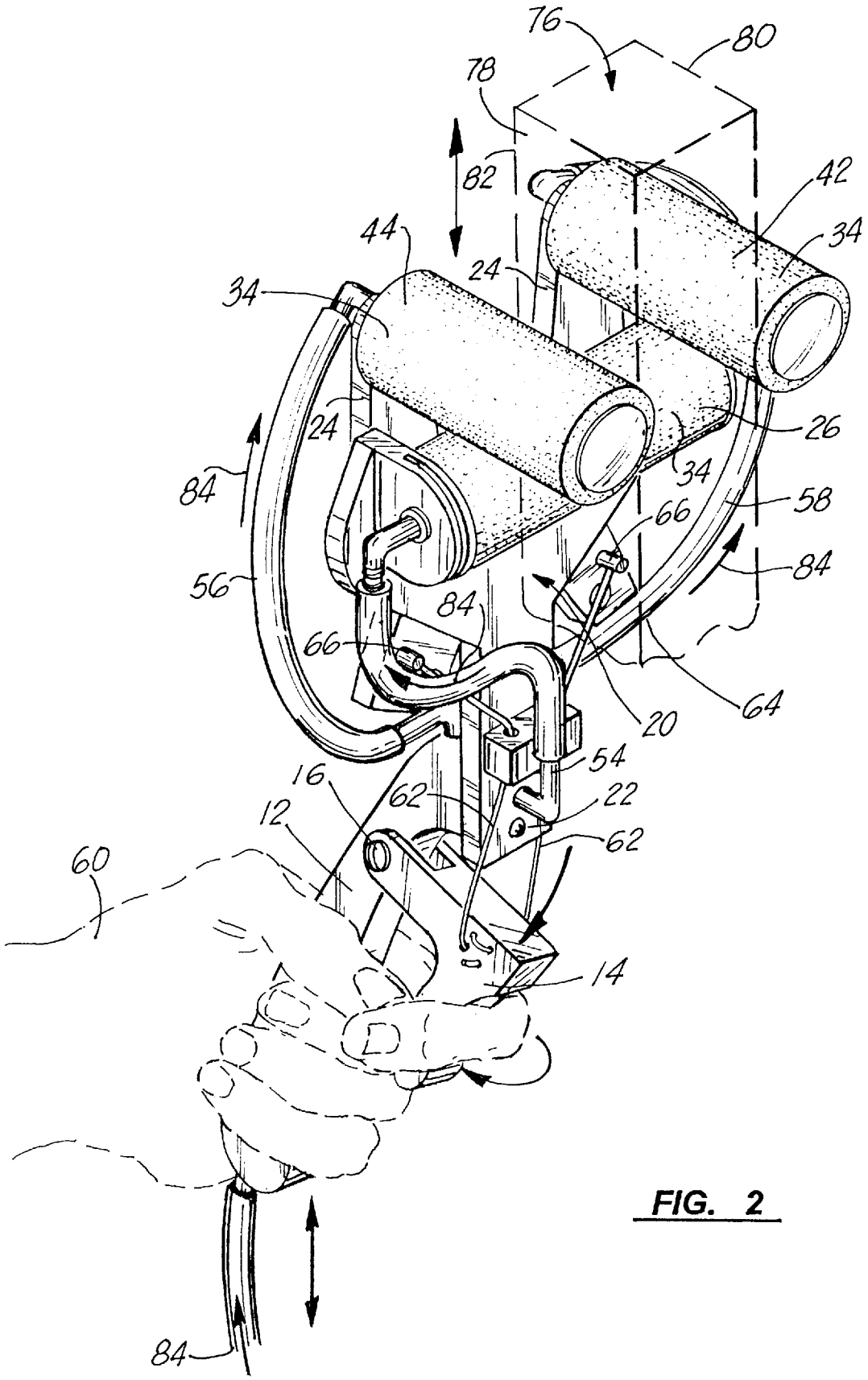
FIG. 2 illustrates an overall perspective view of the apparatus of the present invention while painting a multi-surface object.

A second principal feature of the tri-roller system as shown in the Figures, is the fact that the tri-roller system includes an automatic paint delivery system that will be described at this time. As seen again, in the figures, paint delivery system includes a principal paint delivery line 50 extending upward into an interior channel 52 which in the preferred embodiment would be housed within the handle 12 so therefore cannot be seen in the drawing, which extends from the lower end 53 of the handle upward through the upper end 55 of the handle, as illustrated for example in FIG. 1. In the preferred embodiment, as seen in FIG. 2, the paint would be delivered into line 50 as in the direction of arrow 84, via a system such as a pump or the like which is commonly known in the art but would deliver a consistent supply of paint into the system. The paint would travel through the interior line of handle 12 and would then extend into a three line delivery system, the first line which would extend through the lower end 22 of upper support base 20, via the line 54 with the line 54 feeding paint into the first lower roller 26. The second line 56 and third line 58 would branch off and would deliver paint into the second roller 42 and third roller 44 as illustrated in the Figures. Therefore, the paint delivery system would allow a continuous supply of paint into the three rollers 26, 42, 44, on a continuing basis. As is well known in the art, the paint would be delivered into the core of the rollers and would be forced outward into the sponge-like paint delivery surface 34, so that the paint would then be evenly distributed through the three rollers.

Figure 3:
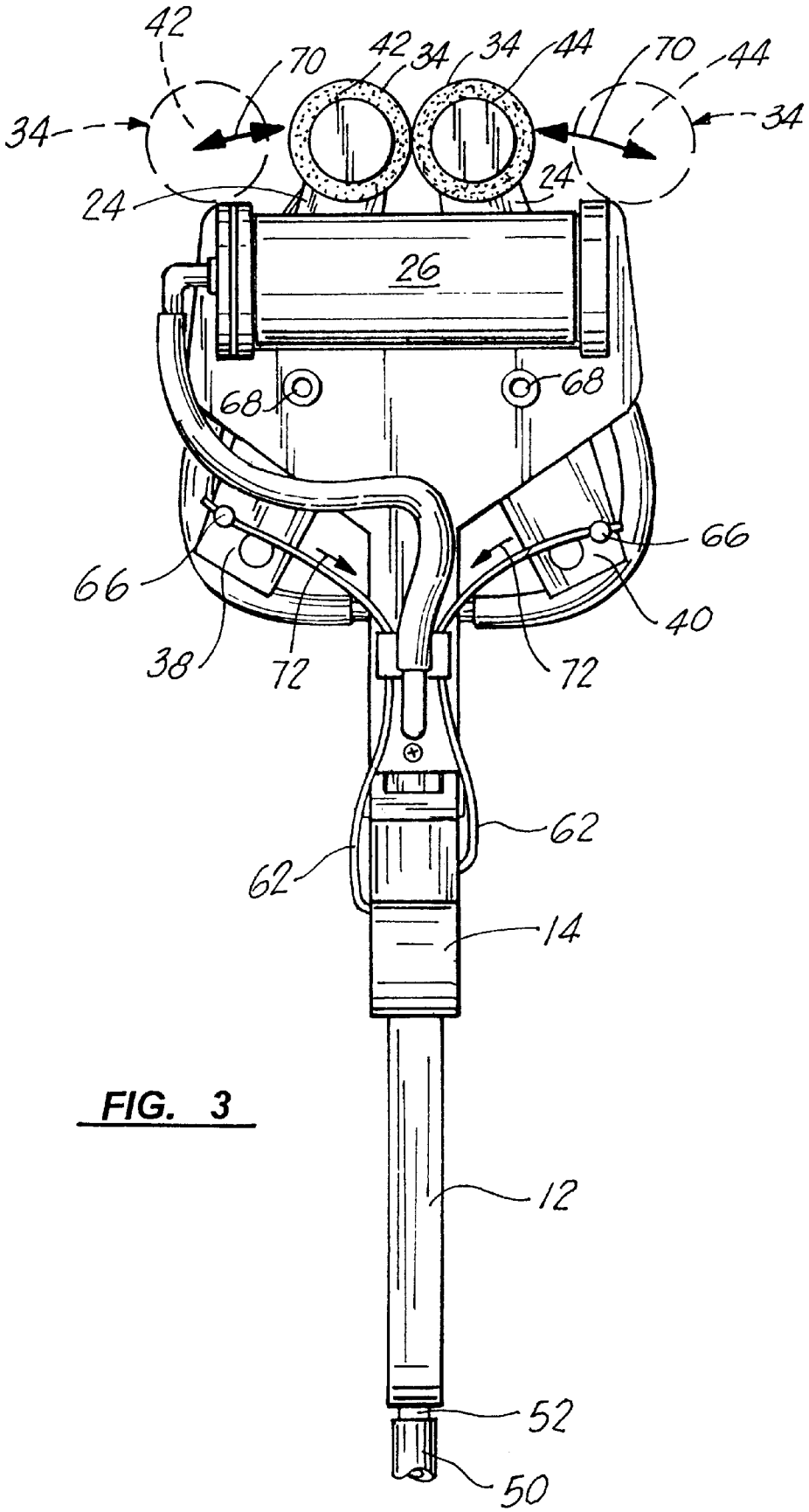
FIG. 3 illustrates a front view of the apparatus of the present invention illustrating the extent of movement of the pair of movable rollers.

Turning now to another important feature of the system of the present invention, reference is made for example to FIGS. 2 and 3. As seen in FIG. 2, a person's hand 60 has grasped the handle 12 of the system and has pulled the trigger 14 mounted along its axis 16. Upon pulling of the trigger 14, there is seen a pair of lines, for example, made of monofilament material 62, each of the lines 62 extending from their first end, secured to trigger 14, and, as seen in FIG. 3, interconnected on their far end to a peg member 66 located on the lower end of each of the arms 38, 40 upon which the rollers 42, 44 are mounted. Because the arms 38, 40, as seen in FIG. 3, are mounted via a single screw 68, the arms therefore are free to rotate in the direction of arrow 72, as seen in FIG. 3. Therefore, for example, as seen in FIG. 3, the rollers 42, 44 may be in the position adjacent one another which each of the surfaces 34 making contact. Upon squeezing of the trigger 14, the monofilament lines would pull in the direction of arrows 72 as seen in FIG. 3, and upon that occurring, each of the mounting arms 38, 40 would move outwardly from the position as seen in full view in FIG. 3, to a position as seen in phantom view in FIG. 3.

Therefore, returning now to FIG. 2, when one would place an object such as a four-sided board 76 to be painted, one would simply pull the trigger 14 as seen in FIG. 2, arms 38, 40 would therefore move outwardly in the direction of arrow 72, as seen in FIG. 3, and the rollers 42, 44 would then paint each of the side surfaces 78, 80, of board 76 and the lower roller 26 would paint the first interior surface 82 of board 76. Therefore, simultaneously, the board 76 would be painted along three of its surfaces and could be done on a continuous basis due to the fact that paint is being continuously delivered therein as seen by arrows 84 in FIG. 2.

Figure 4:
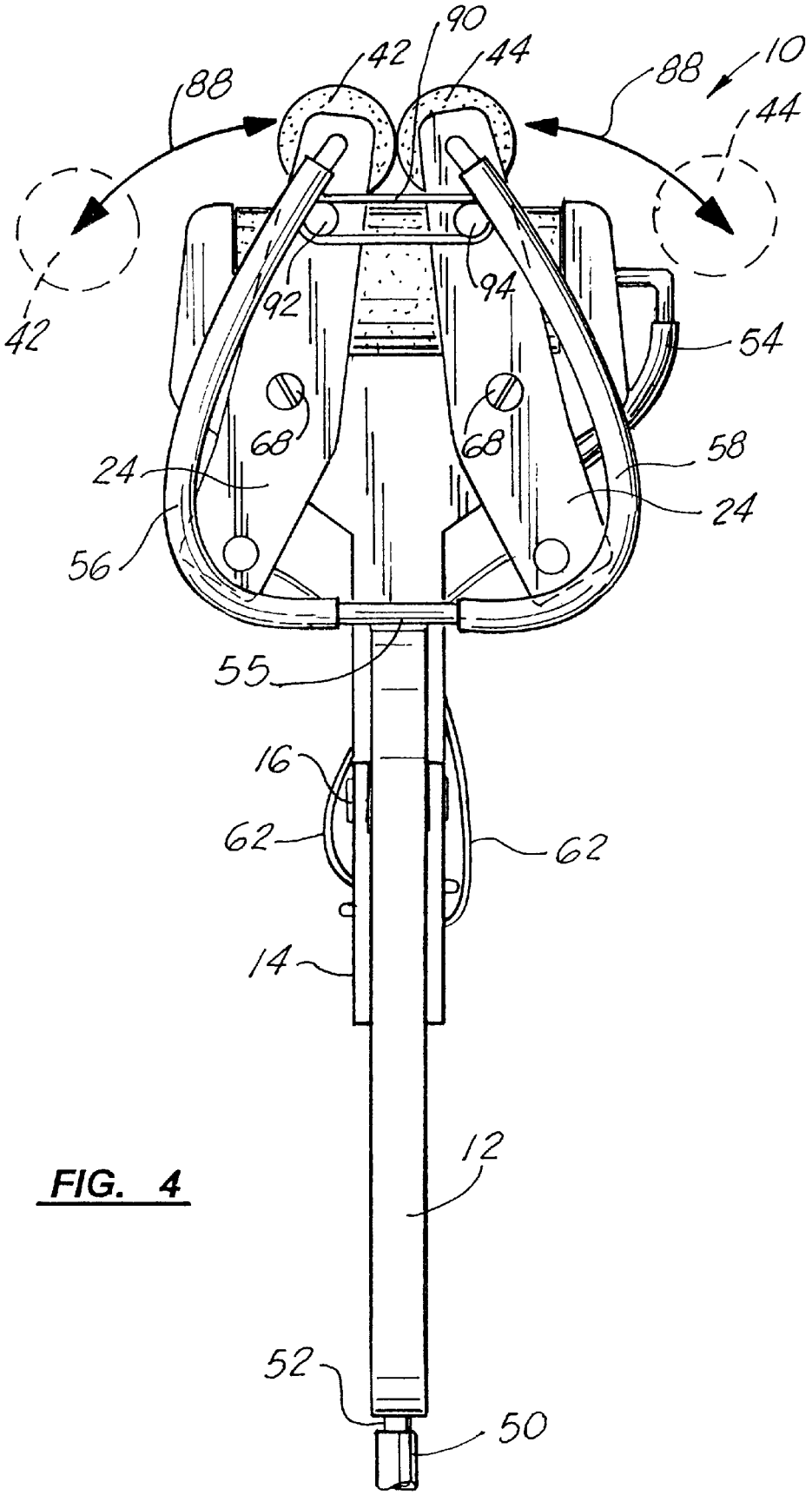
FIG. 4 illustrates a rear view of the system of the present invention illustrating the extent of movement of the pair of moveable rollers during the painting process.

Reference is made to FIG. 4 where there is seen the rear view of the roller apparatus 10. As seen clearly, the paint delivery lines 56 and 58 to the pair of rollers 42, 44 and again the rollers 42, 44 are shown in juxta position to another in close relationship. As was described earlier, when the trigger 14 is squeezed by a user as seen in FIG. 2, the rollers would then be moved to the position as seen by arrows 88 in FIG. 4. However, because the rollers 42, 44 should be maintained in close tight relationship against a surface such as board 76 as seen in FIG. 2, there is included a means for assuring that when rollers 42, 44 are expanded outward into the positions as seen in FIGS. 3 and 4, that they would have a means for returning the rollers back up against the sides, for example, 78, 80 of board 76. This means is seen in FIG. 4 as an expandable member 90 which is mounted around pegs 92, 94. The expandable member mounted may be a continuous spring or a continuous band of elastic so that when the rollers 42, 44 are expanded outward as seen in FIGS. 3 and 4, the expandable member 90 would force the rollers 42, 44 back into close relationship against the bias of the expandable member 90. Therefore, when the rollers are expanded outward to accommodate the board 76, as seen in FIG. 2, the expandable member 90 would force the rollers 42, 44 up against the sides 78, 80 of the board and would therefore assure that all three surfaces 78, 80, and 82 of the board would be painted simultaneously by the apparatus. The rubber band only assures that the sides of the board are painted; the face of the board (side 82) depends upon the user applying pressure to paint it. In no way does the expandable member 90 (rubber band) assure side 82 is painted. When the painting job is completed, the rollers would be returned, via expandable member 90, to their closed position, and would be reopened utilizing trigger 14, as described earlier.

Although in the content of this application, reference is made to the fact that the apparatus receives paint automatically from a paint source so that the paint is delivered on a non-interrupted basis, it is foreseen that in the event an automatic paint delivery system is not available, that the hand-held apparatus could be utilized in the manner as a conventional paint roller in that the rollers could be rolled into paint within a conventional paint pan, and the paint could then be applied manually from the rollers onto the surface to be painted.

In the preferred embodiment, as seen in the Figures, the apparatus would be a hand-held apparatus which could be operated by a single individual, including the expandability of the rollers and accommodating the painter apparatus onto various sized boards 76, as seen in the Figure. The movement of the trigger 14 would allow expansion of the rollers to their widest degree as seen in FIG. 4, yet the expandable member 90 would require that the rollers want to return to their closed positions as seen in FIG. 4. In terms of construction, the apparatus may be constructed of lightweight plastic material, and any and all fixtures may be metal or may be type of plastic studs that would ensure the long life of the system. It is foreseen that the rollers may be mounted so as to be easily removed from the apparatus for cleaning. Or, the apparatus may be of the material as described which would allow it to be completely submerged in a cleaning solution such as water or the like, without damaging any parts of the apparatus yet cleaning the surfaces of the rollers once a painting task has been completed.

The foregoing embodiments are presented by way of example only; the scope of the present invention is to be limited only by the following claims.

I claim:

1. An improved painting apparatus, comprising:

a. a main body;

b. a handle secured to the main body for grasping the apparatus;

c. a first paint roller mounted on the main body;

d. a pair of paint rollers mounted in parallel relationship to one another, and perpendicular to a first paint roller; each of the pair of paint rollers movably mounted to the main body;

e. means to bias the pair of paint rollers to a closed position, f. a squeezable trigger for providing movement of the pair of paint rollers from the closed position to an open position so that the pair of paint rollers may secure an object to be painted therebetween, while the first paint roller secures the object to be painted along another surface; and g. means to automatically deliver paint to the first paint roller and the pair of paint rollers as the paint assembly is being used.

2. The apparatus in claim 1, wherein the means to deliver paint to the rollers further comprises a plurality of paint flow lines delivering paint from a source to a core of each of the rollers on a continuous basis while painting.

3. The apparatus in claim 1, wherein the assembly comprises lightweight, washable materials.

4. The apparatus in claim 1, wherein the pair of paint rollers are mounted to arms which are movably secured to the main body.

5. The apparatus in claim 1, wherein the compressible member further comprises a trigger for securing lines between itself and arms, so that upon squeezing of the trigger, the arms move the pair of rollers apart from one another.

6. An improved painting assembly, comprising:

a. a main body;

b. a handle secured to the main body for grasping the painting assembly;

c. a first paint roller mounted on the main body;

d. a pair of paint rollers mounted in parallel relationship to one another, and perpendicular to the first paint roller; each of the pair of paint rollers secured to arms movably mounted to the main body;

e. means to bias the pair of paint rollers in a closed position, f. a trigger mounted on the handle for providing movement of the two arms from a closed position to an open position so that the pair of rollers may secure opposite surfaces of an object to be painted, while the first paint roller secures a third surface of the object to be painted; and g. means to deliver paint to the first paint roller and the pair of rollers as the paint assembly is being used.

7. The painting assembly in claim 6, wherein the means to deliver paint to the rollers on the painting assembly further comprises a series of paint flow lines delivering paint into the paint rollers from a source, such as a pump.

8. The paint assembly in claim 6, wherein the assembly comprises lightweight, washable materials.

9. A hand-held painting apparatus, comprising a main body supporting a plurality of paint rollers with at least one of the rollers in fixed rotation on the body, and a pair of rollers fixed in perpendicular relationship to the first roller, and further comprising a compressible trigger for securing lines between itself and arms, so that upon compressing of the trigger the pair of rollers move between a first closed position to a second open position so as to allow the three rollers to apply paint to three surfaces of an object simultaneously.

10. The assembly in claim 9, wherein the assembly further comprises a hand held assembly.

11. The apparatus in claim 9, further comprising means to deliver paint to the rollers, said means further comprising a plurality of paint flow lines delivering paint from a source to a core of each of the rollers on a continuous basis while painting.

12. The apparatus in claim 9, wherein the assembly comprises lightweight, washable materials.

13. The apparatus in claim 9, wherein the means for allowing the pair of paint rollers to become moveable further comprises arms which are movably secured to the main body.

14. The apparatus in claim 9, further comprising a handle portion secured to the main body for grasping during use.

15. The apparatus in claim 9 further comprising an expandable member secured between the arms, so that when the arms are moved apart by the trigger, the expandable member automatically returns the arms to their closed positions.

* * * * *